US007497690B2

(12) United States Patent
Sang

(10) Patent No.: US 7,497,690 B2
(45) Date of Patent: Mar. 3, 2009

(54) MOUNTING DEVICE FOR AN ELECTRIC PLUG COUPLING

(75) Inventor: Cho Yong Sang, Seoul (KR)

(73) Assignee: Huf Hülsbeck & Fürst GmbH & C. KG, Velbert (DE)

( * ) Notice: Subject to any disclaimer, the term of this patent is extended or adjusted under 35 U.S.C. 154(b) by 330 days.

(21) Appl. No.: 11/547,907

(22) PCT Filed: Jan. 11, 2006

(86) PCT No.: PCT/EP2006/000176

§ 371 (c)(1),
(2), (4) Date: Oct. 5, 2006

(87) PCT Pub. No.: WO2006/117026

PCT Pub. Date: Nov. 9, 2006

(65) Prior Publication Data

US 2008/0032549 A1 Feb. 7, 2008

(30) Foreign Application Priority Data

Apr. 28, 2005 (DE) ..... 10 2005 020 207

(51) Int. Cl.
*H01R 33/00* (2006.01)

(52) U.S. Cl. ..... 439/34; 340/5.72

(58) Field of Classification Search ..... 439/34, 439/374, 376, 342; 340/5.72; 292/336.3; 307/10.1

See application file for complete search history.

(56) References Cited

U.S. PATENT DOCUMENTS 6,083,027 A * 7/2000 Sato ..... 439/376
6,910,303 B1 6/2005 Mathofer
6,948,953 B2 * 9/2005 Fukamachi ..... 439/342
7,018,214 B2 * 3/2006 Fukunaga et al. ..... 439/34
2002/0177331 A1 11/2002 Kasper et al.

FOREIGN PATENT DOCUMENTS

DE 199 47 977 C 1 5/2001
DE 100 62 042 A 1 6/2002
DE 101 21 432 A 1 11/2002
EP 1 225 004 A2 11/2002
EP 1 437 461 A2 7/2004
EP 1 507 054 A2 2/2005

* cited by examiner

*Primary Examiner*—Felix O Figueroa
(74) *Attorney, Agent, or Firm*—Fay Sharpe LLP

(57) ABSTRACT

The mounting device serves to receive an electrical plug coupling for the connection of an electronic circuit assembly. It has a coupling receptacle (2), which is pivotally mounted on a door handle carrier (10) and is locked against tilting in an installation position and can be pivoted into an operational position. The coupling receptacle (2) is guided by means of two formations (9) projecting on opposite sides in parallel guide slots (7). The guide slots (7) each have at least one slot constriction (8"), through which the formations (9) can be forced only after overcoming a predetermined threshold force. Rigidly connected to the coupling receptacle (2) is at least one tilt locking element (13*b*). The tilt locking element comes into engagement, in the installation position, with an opposing component (16) fixed to the door and then comes out of engagement with the opposing component when the formations (9) have passed the slot constrictions (8") in the guide slots (7).

8 Claims, 5 Drawing Sheets

MOUNTING DEVICE FOR AN ELECTRIC PLUG COUPLING

The invention relates to a mounting device for an electric plug coupling for connecting an electronic circuit assembly incorporated in a door handle to a coupling receptacle, which is pivotally mounted on a door handle carrier and is secured against tilting in a first installation position and is movable out of the installation position into an operational position.

DE 100 62 042 B4 discloses a mounting device of this type, in which a plug coupling portion is connected by means of a short cable to the door handle and may be inserted into a coupling receptacle mounted on the door handle carrier. The plug socket is arranged on the carrier to be pivotable between an installation position and an operational position. The plug socket is lockable in the installation position by means of a latch device, which provides the necessary counteracting force to the insertion of the plug coupling into the receptacle. The latch device consists of a lug formed on the coupling receptacle and a latch receptacle fixed to the carrier. The cooperating latch elements must be formed with relatively close tolerances in order that, on the one hand, the locking force is sufficient for the insertion of the plug coupling and, on the other hand, pivoting back of the coupling receptacle after creating the plug connection is possible without damage. For this purpose, the mounting tolerances of the coupling receptacle in the pivotal bearing and the tolerances of the locking elements cooperating in the installation position must be matched relatively precisely to one another, which necessitates corresponding manufacturing expense.

It is thus the object of the invention to construct the mounting device so that reliable locking against tilting of the coupling receptacle in the installation position and simple movement into an operational position is possible with relatively simple means.

In the solution of this object, the invention starts from the consideration that the functions of locking in the installation position and releasing the lock to move the coupling receptacle into the operational position must be structurally and functionally associated with different components.

Starting from a mounting device of the type referred to above, the invention solves the object underlying it if the coupling receptacle is guided by means of two formations projecting on opposite sides in parallel guide slots in a mounting component, the guide slots having at least one slot constriction at corresponding positions, which may be passed by the formations only by overcoming a predetermined threshold force and if at least one tilt locking element is rigidly connected to the coupling receptacle, whereby the tilt locking element can move, in the installation position, into engagement with an opposing component fixed to the door for the purpose of tilt locking and moves away from the opposing component, whilst releasing the tilt locking, after the formations have passed the slot constrictions in the guide slot.

As a result of the division of the mounting device into a coupling receptacle and a mounting component, it is possible to associate the functions of tilt locking on the one hand and the slot constriction producing the locking with different elements. The tilt locking can be achieved by a simple abutment between the coupling receptacle and handle carrier. The matching of the parallel guide slots to the cross-sections of the formations projecting from the coupling receptacle is also technologically no problem. When moving the coupling receptacle relative to the outer mounting component, the tilt locking is released and the mounting component may be pivoted together with the coupling receptacle into the operational position without problem. There are no particular requirements as regards the dimensional accuracy of the pivotal mounting.

It is provided in an embodiment of the invention that at least one guide skid constituting a tilt locking element is formed on the coupling receptacle and extends substantially parallel to the insertion direction of the plug coupling. Since the guides on the one hand and the insertion direction of the plug coupling on the other hand extend substantially parallel, the guide skid can be moved out of the engagement region on the door handle carrier, when the coupling receptacle is moved linearly, whereafter the mounting component may be pivoted with the coupling receptacle into the operational position.

In a preferred embodiment of the invention, the opposing component serving as a tilt lock is constructed in the form of a guide groove fixed to the carrier, which receives the adjacent skid in the installation position and extends substantially parallel to the guide slots in the mounting component. The coupling receptacle is preferably provided with two symmetrically arranged, parallel guide skids, which engage in corresponding guide grooves fixed to the carrier, whilst the coupling receptacle is situated in the installation position.

A preferred embodiment of the invention is characterised in that each guide slot is provided with two slot constrictions, a first slot constriction being disposed close to one end of the slot and the second slot constriction defining that position of the receptacle at which the engagement of the tilt locking element with the opposing component fixed to the door ceases.

The invention will be explained below in more detail with reference to an exemplary embodiment illustrated in the drawings, in which.

Figure 1:
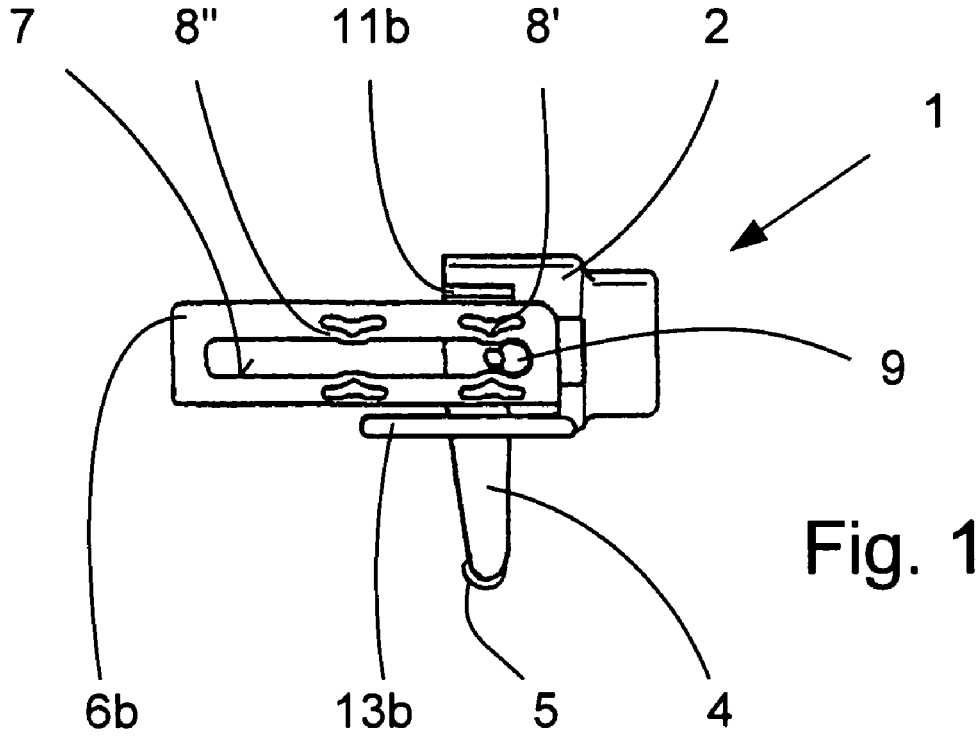
FIG. 1 is a side view.
Figure 2:
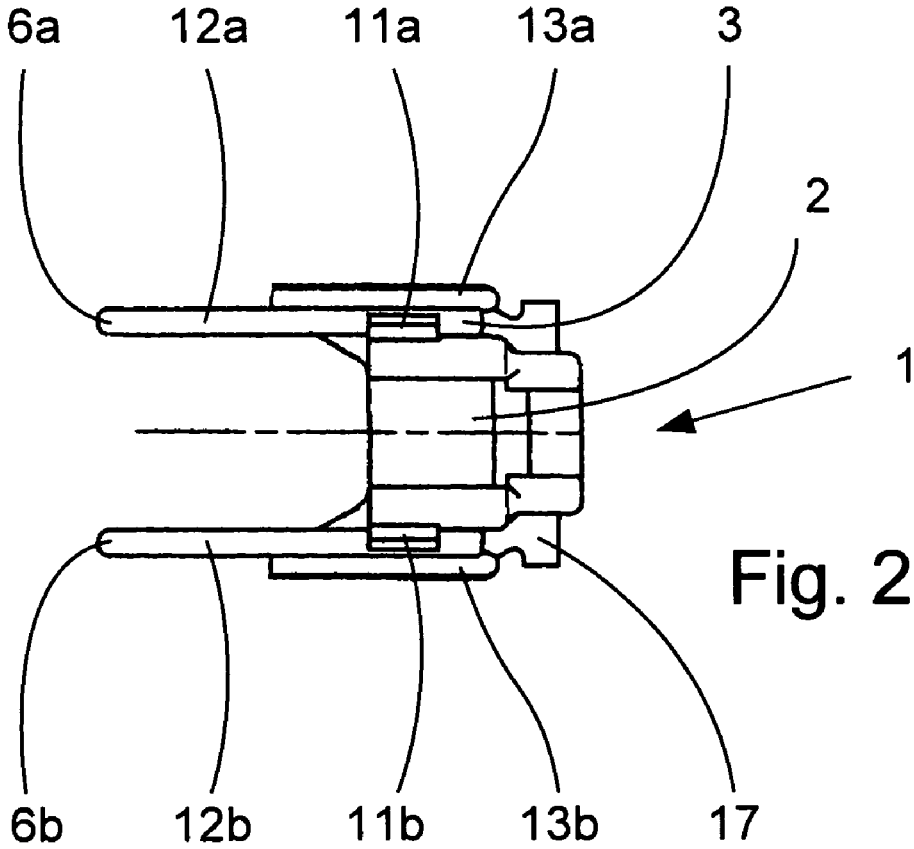
FIG. 2 is a plan view of an exemplary embodiment of a two-part mounting device comprising a coupling receptacle and a mounting component.
Figure 3:
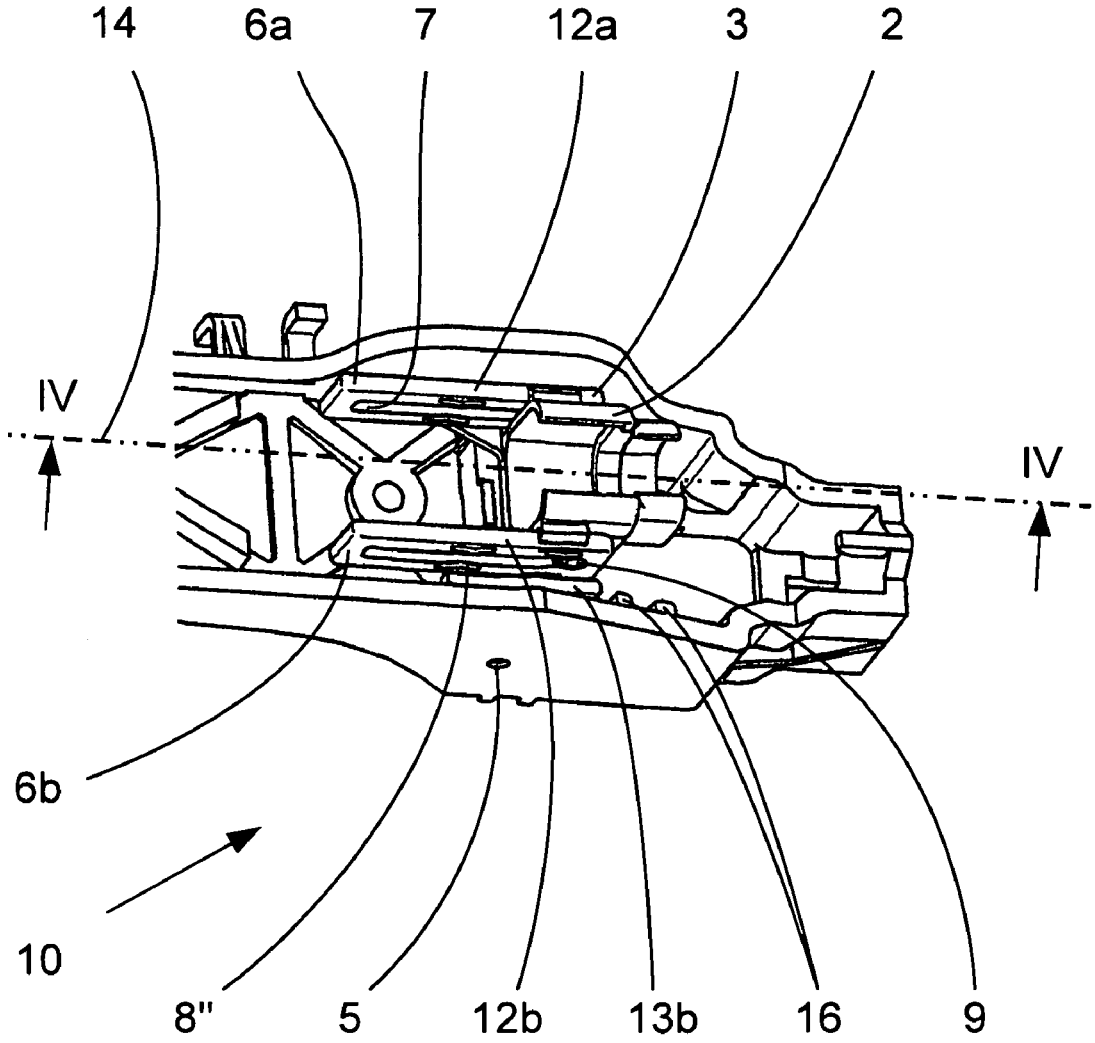
FIG. 3 is a perspective view of a section of a handle carrier, wherein the mounting device in accordance with FIG. 1 or 2 on the side of the handle carrier remote from the door handle is in the customer delivery state.

The mounting device 1 shown in FIGS. 1 and 2 consists of two portions, namely a coupling receptacle 2 and a mounting portion 3. The mounting portion 3 is provided with a pivotal bearing 5 via a bearing arm 4 and is connected via the pivotal bearing 5 to a door handle carrier 10 (FIG. 3). The mounting component has a bifurcated holder with two parallel extending bars 6*a*, 6*b*, which are formed on a yoke 17 connected to the bearing component. Formed in each bar 6*a* and 6*b* is a guide slot 7 in the form of an elongate hole. Arranged near to the rear end of the guide slot 7 shown in FIG. 1 is a first constriction 8' of the slot and approximately in the centre of the slot 7 there is a second constriction 8" of the slot.

The coupling receptacle 2 has an approximately C-shaped, stepped cross-sectional profile and provides support on all sides to a plug coupling (not shown) inserted into the interior of the receptacle. The plug receptacle 2 is mounted in the guide slot 7 by means of formations 9 projecting on opposite sides into the guide slot 7. The coupling receptacle 2 can be moved along the straight guide path in the slot 7 from the right-hand end position shown in FIG. 3 into the opposite end position. For this purpose, the threshold forces between the formations 9 on both sides and the two constrictions 8' and 8" in the slot must be overcome. The threshold force necessary for this purpose is so adjusted that it exceeds the insertion force to be expected when inserting the coupling portion (plug) into the other portion (socket, not shown in the drawings) already situated in the receptacle 2. The formations 9 can be constructed in the manner of journal pins. In the illustrated exemplary embodiment, they have a lug projecting in the longitudinal direction of the slot 7. The coupling receptacle 2 has guide ribs 11*a* and 11*b* which project on opposite sides and which are so constructed and arranged that they can engage slide tracks 12*a* and 12*b* on the parallel support bars 6*a* and 6*b* and thus holds the receiving component 2 guided in the guide 7 in a position which is aligned with the mounting component 3. This aligned position is maintained even when the receptacle 2 is slid in the longitudinal direction along the guide bars 6*a* and 6*b* and the two components are pivoted together about the bearing axis 5.

Also formed on the receptacle 2 are two guide skids 13*a* and 13*b*. The guide skids extend substantially parallel to the receptacle axis 14 (FIG. 3) of the receptacle component 2 and to the guide slot 7 in the support bars 6*a* and 6*b* of the mounting component. The guide skids 13*a*, 13*b* serve, as will be explained below with reference to FIGS. 3 to 8, to secure the mounting device 1 in the installation position of FIG. 7 against tilting. The skids can bear against the two parallel ribs 16, fixed to the carrier, which secure a respective rib in the installation position of the mounting device 1 against tilting.

The provided positions of the two-part mounting device 1 relative to the handle carrier 10 and the relative positions of the two portions 2 and 3 of the mounting device 1 in the different positions and in the transition between the operational and installation positions will be explained below with reference to FIGS. 3 to 5.

Figure 4:
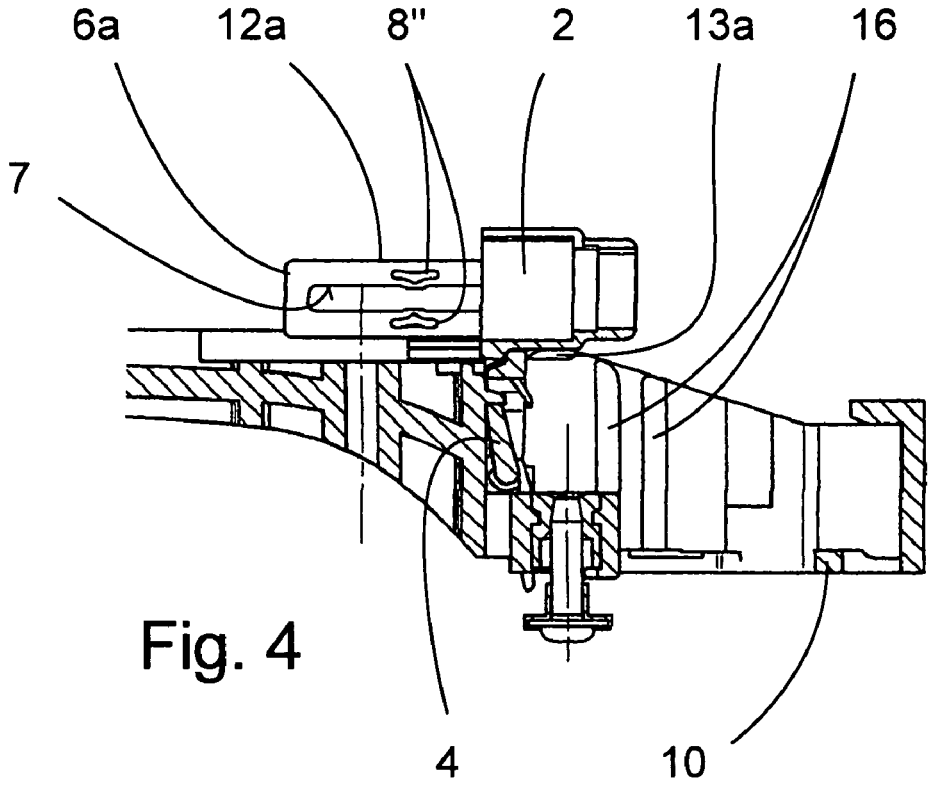
FIG. 4 is a longitudinal sectional view on the section line IV-IV in FIG. 3.
Figure 5:
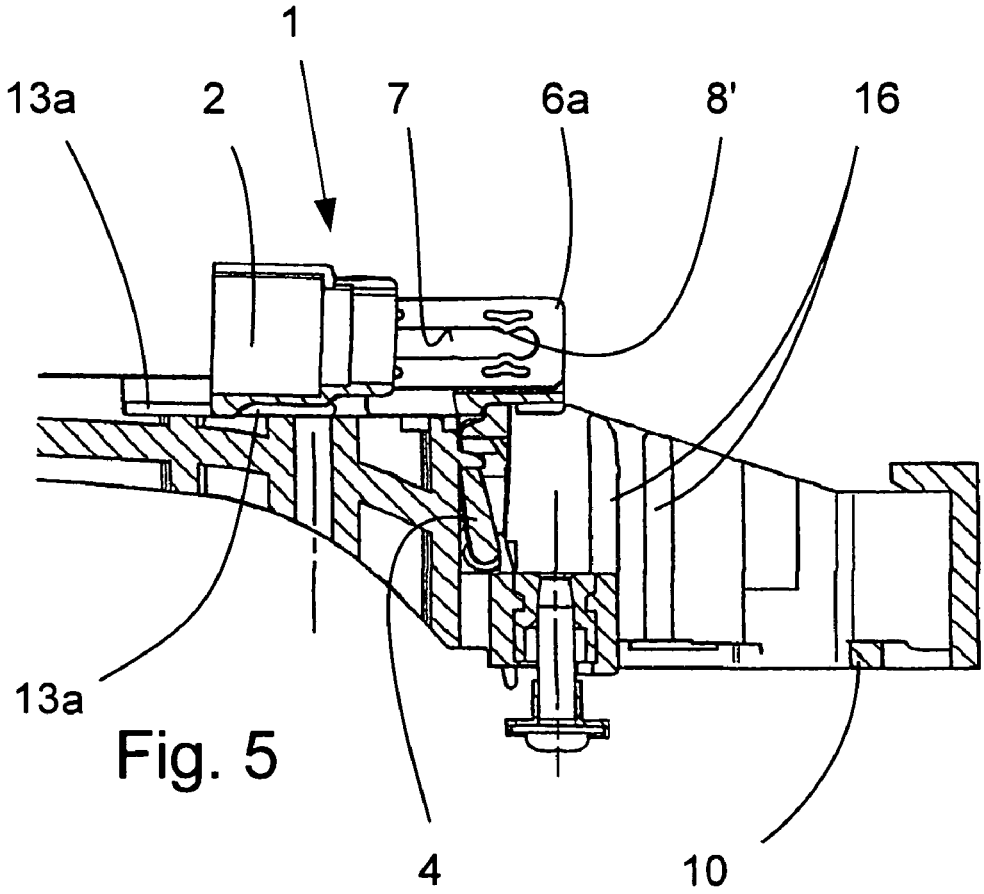
FIG. 5 shows the device of FIG. 4 in an operational position, from which pivotal movement into an installation position also occurs.

FIGS. 3 and 4 illustrate the mounting device 1 in a state in which it is delivered to customers after fastening to the handle carrier 10. In the delivery position, the coupling receptacle 2 is located in the right-hand end position in FIG. 4, in which the laterally projecting formations 9 are locked at the end of the elongate hole behind the first constriction 8' of the slot. The installation of the socket (not shown) with a cable connection to the vehicle/vehicle control device is effected in this position.

The coupling mounting 2 is then slid into the left-hand end position (FIG. 5) whilst overcoming the predetermined threshold forces between the constrictions 8' and 8" in the slot and the peg-shaped projections 9' engaging in the slots. This position corresponds to the subsequent operational position and is the starting position for pivoting the mounting device 1 into the installation position.

Figure 6:
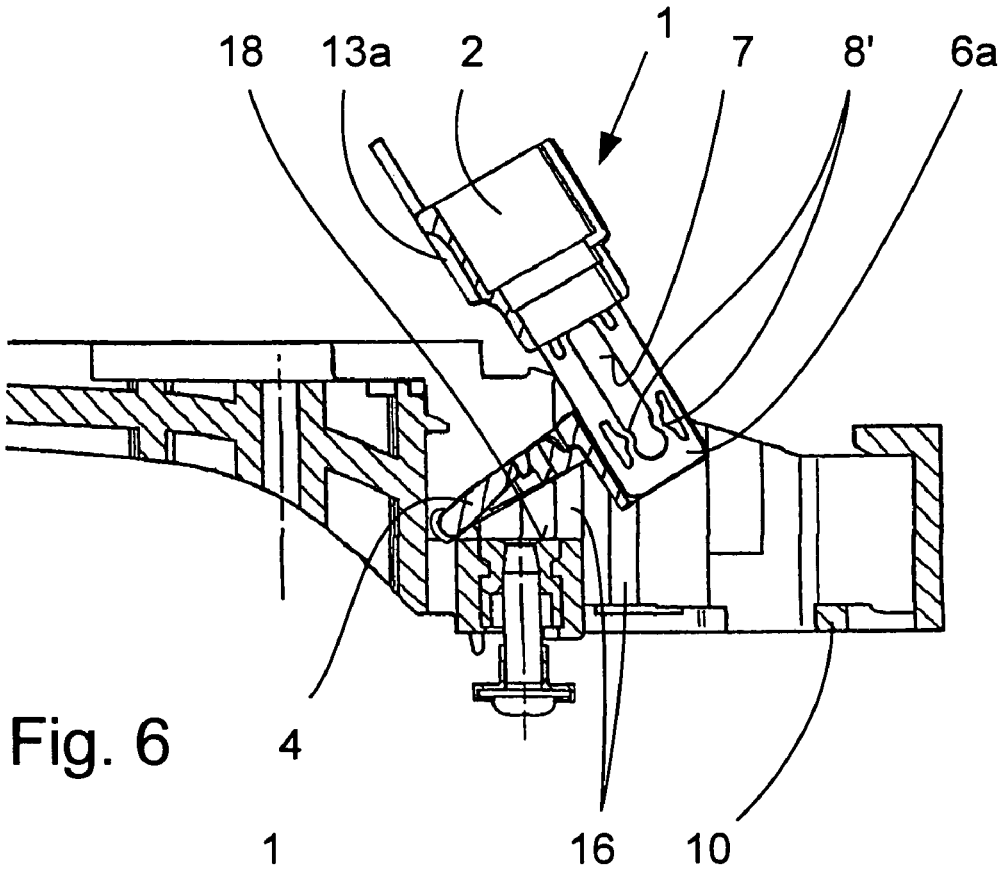
FIG. 6 shows the device of FIG. 5 in an intermediate pivotal position of the two-part mounting device.
Figure 7:
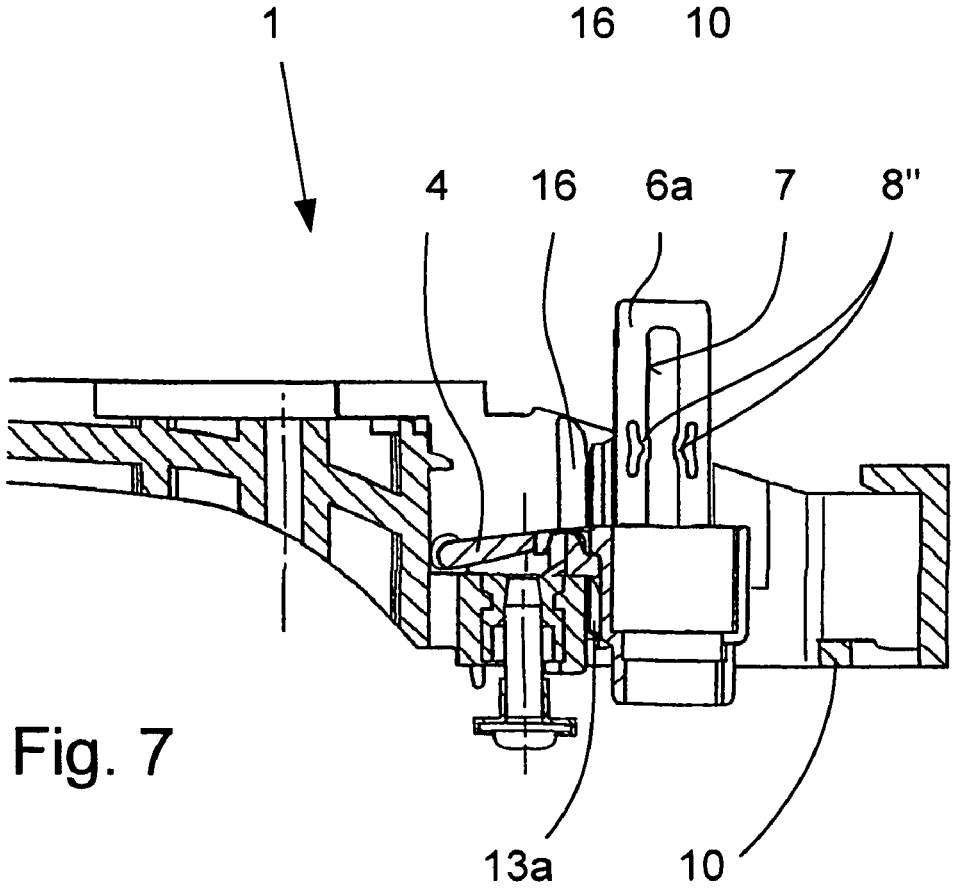
FIG. 7 shows the device of FIG. 5 in the installation position of the two-part mounting device.
Figure 8:
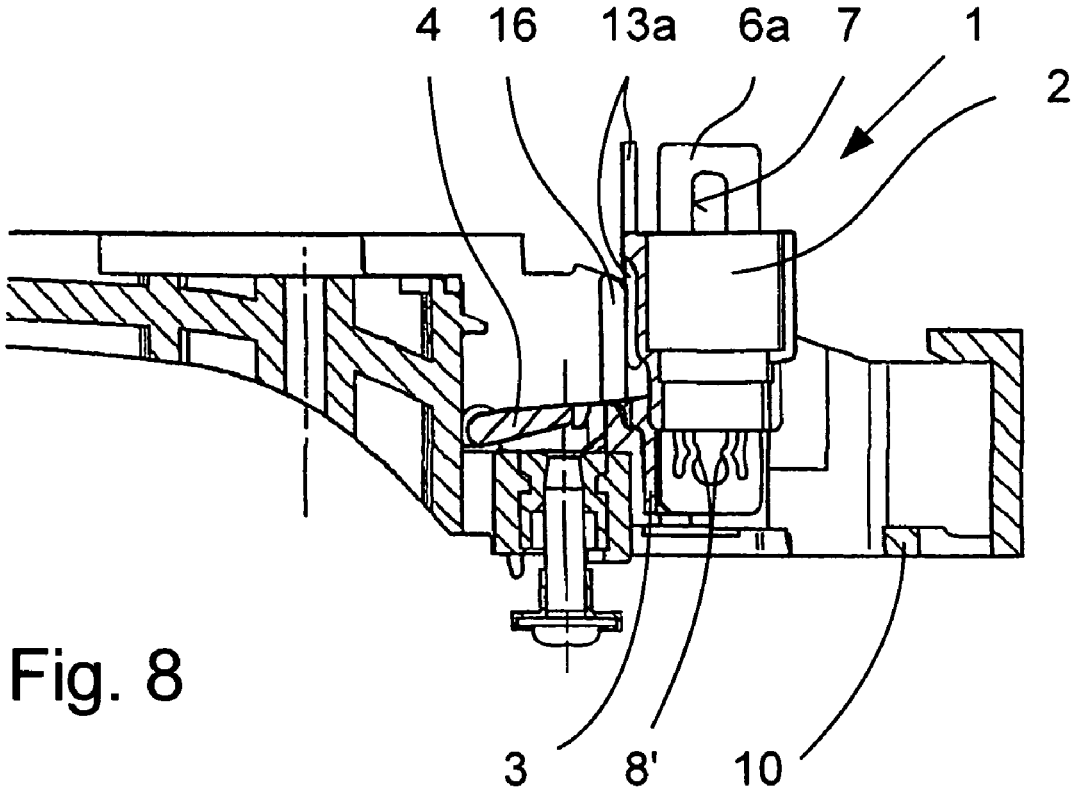
FIG. 8 is a view similar to that of FIG. 7 after lifting the coupling receptacle out of the installation position.

FIG. 6 shows an intermediate position of the mounting device 1 in a position before the engagement of the guide skids (only the guide skid 13*a* may be seen in FIG. 6) into a receiving groove defined between the two parallel ribs 16 fixed to the carrier. The coupling receptacle 2 is held during the pivotal movement in the upper end position so that the guide skids 13*a* and 13*b* can be moved unimpeded over the left-hand rib 16. The bearing arm 4 is then pivoted further to an abutment 18 fixed to the handle carrier 10, whereby the guide skids 13*a* and 13*b* are moved into alignment with the grooves defined between the ribs 16. The coupling receptacle 2 is then slid downwardly along the slot 7 into the installation position, which is shown in FIG. 7. In this installation position, the formations are caught behind one of the two constrictions 8' and 8" in the slot. At the same time, the skids 13*a* engage in the groove between the ribs 16 fixed to the carrier and act as a tilt lock, whereby pivoting back of the pivotal arm 4 with the mounting device 1 is prevented. The mounting device 1 thus has, in the installation position shown in FIG. 7, a positionally fixed position secured against tilting, which is maintained by the slot constrictions 8' in cooperation with the pegs 9 (FIGS. 1 and 3) and the skids 13*a* and 13*b* engaging in the grooves between the ribs 16. In this installation position (FIG. 7), the handle carrier 10 is mounted on the vehicle from the interior, whereafter the plug (not shown) is then inserted from the exterior into the narrower section of the coupling receptacle 2, situated at the bottom in FIG. 7, and into the coupling socket (also not shown) already inserted into the broadened section of the coupling receptacle.

After completion of the coupling process between the socket and plug, the handle, which is also not shown in the drawing and to which the plug is connected, is then installed.

Figure 9:
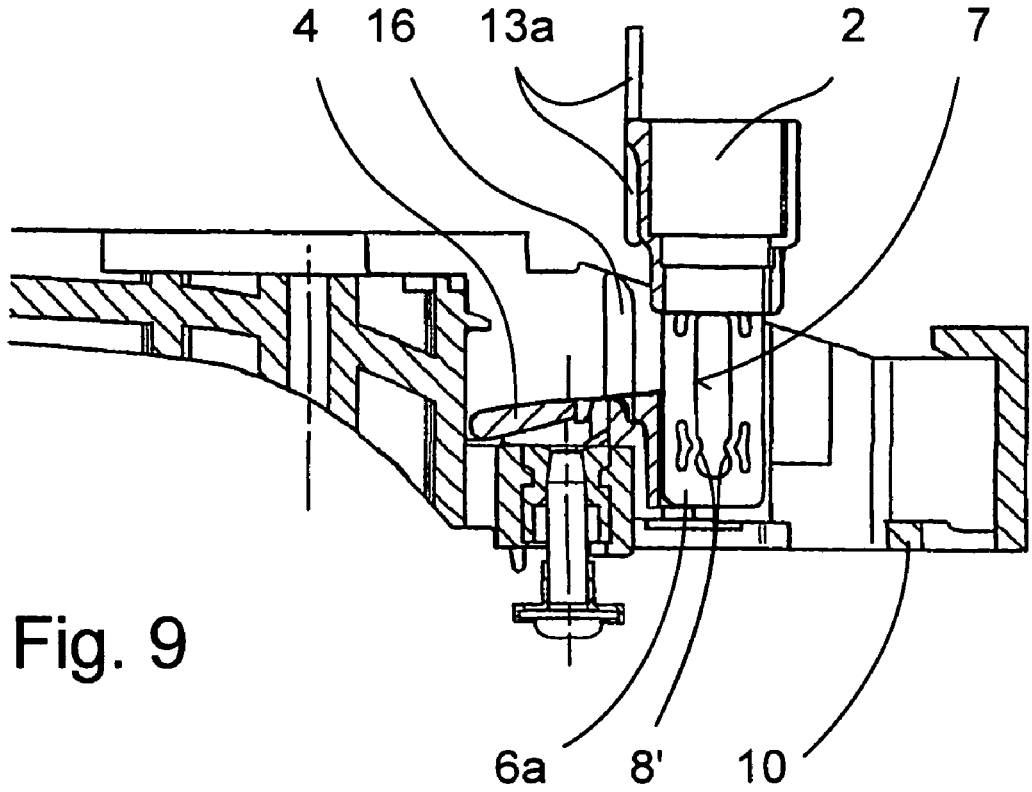
FIG. 9 is a view similar to that of FIG. 8 after lifting the coupling receptacle out of the tilt lock on the handle carrier.

After overcoming the threshold force at the first slot constriction 8' in the direction of the slot 7, the coupling receptacle 2 is slid to the second locking point at the slot constriction 8", whereby the direction of movement is fixed and secured against tilting by the skids 13*a* engaging the ribs 16 corresponding to the installation position. The second locking point 8" ensures that the plug is properly coupled to the socket. Only after overcoming the threshold force at the second locking point 8" is the plug receptacle slid so far in the direction of the upper end of the slot (FIG. 8) that the skids 13*a* are completely removed (FIG. 9) from the groove defined between the ribs 16 so that the two-part mounting device 1 may be folded back into the operational position shown in FIG. 5 whilst pivoting the bearing arm 4 (FIG. 6).

As will be apparent from the description above, the functions of locking the installation position by the interaction of the slot constrictions 8' and 8" and the bearing pegs 9 on the one hand and the tilt locking by the cooperation of the guide skids 13*a* and 13*b* and the ribs 16 are associated with different components adjacent with one another in pairs. The adjacent components may be very precisely matched to one another with relatively small manufacturing expense.

In principle, one locking point (e.g. the slot constriction 8') is sufficient for locking in the installation position (FIG. 7). However, the second locking constriction 8" spaced from the first slot constriction 8' increases the reliability of the production of the coupling connection between the coupling components, which are not shown in the drawings, i.e. the socket with the plug on the handle. Only after overcoming the threshold force at the locking point 8" is the tilt lock formed between the components 13*a*, 13*b* and 16 also released.

Instead of the pair of ribs 16 shown in the Figures, which laterally define a guide groove, a single rib 16 can also fulfil the tilt locking function. Furthermore, the skids 13*a* can also be formed externally on the formations 9 in a modified embodiment. The at least one rib on the handle carrier must then be so arranged that it cooperates with the projecting skid on the adjacent formation in the installation position (FIG. 7) and ensures the tilt locking in the installation position.

The invention claimed is:

1. A mounting device for an electrical plug coupling for connecting an electronic circuit assembly incorporated in a door handle, said device comprising a coupling receptacle, which is pivotally mounted on a door handle carrier and is locked against tilting in an installation position and is movable into an operational position, wherein the coupling receptacle is guided by means of two formations, projecting on opposite sides, in parallel guide slots in a mounting component, the guide slots having at least one slot constriction at corresponding positions, which may only be passed by the formations by overcoming a predetermined threshold force, and at least one tilt locking element is rigidly connected to the coupling receptacle, whereby the tilt locking element is adapted to come into engagement in the installation position with an opposing component fixed to a door for the purpose of tilt locking and moves away from the opposing component while releasing the tilt locking after the formations have passed the slot constrictions in the guide slots.

2. The mounting device as claimed in claim 1, wherein at least one guide skid constituting a tilt locking element is formed on the coupling receptacle and extends substantially parallel to an insertion direction of the plug coupling.

3. The mounting device as claimed in claim 2, wherein the opposing component serving as a tilt lock is constructed in the form of a guide groove fixed to the door handle carrier, which guide groove receives the adjacent guide skid in the installation position and holds the guide slots in the mounting component in a predetermined direction.

4. The mounting device as claimed in claim 2, wherein the coupling receptacle is provided with two of the guide skids, arranged symmetrically and in parallel.

5. The mounting device as claimed in claim 1, wherein the mounting component has two parallel support bars, in which the guide slots are formed, each support bar having at least one edge, wherein formed on the at least one edge of each support bar there is a slide track parallel to the guide slot, and wherein at least one elongate guide element projects from the coupling receptacle such that it is adapted to engage the slide track on the adjacent support bar and limits relative tilting movement between the coupling receptacle and the mounting component.

6. The mounting device as claimed in claim 1, wherein each guide slot is provided with two of the slot constrictions which are mutually spaced, a first slot constriction being arranged close to one end of the slot and the second slot constriction defining that position of the coupling receptacle at which the engagement of the tilt locking element with the opposing component fixed to the door ceases.

7. The mounting device as claimed in claim 1, wherein the mounting component is connected to the door handle carrier by means of a pivotal bearing and is pivotable between the installation position and the operational position.

8. The mounting device as claimed in claim 3, wherein the coupling receptacle is provided with two of the guide skids, arranged symmetrically and in parallel.

* * * * *